United States Patent [19]

Chang

[11] Patent Number: 4,723,301

[45] Date of Patent: Feb. 2, 1988

[54] CONTAINER RESEALABLE SEALING DEVICE CONSTRUCTION

[76] Inventor: Sung-Choi Chang, 48 Mountainview Rd., Cresskill, N.J. 07626

[21] Appl. No.: 835,619

[22] Filed: Feb. 3, 1986

[51] Int. Cl.[4] ..... B65D 33/16; B65D 33/20

[52] U.S. Cl. ..... 383/66; 206/632

[58] Field of Search ..... 206/632, 626; 383/66; 220/260, 359

[56] References Cited

U.S. PATENT DOCUMENTS

| | | | |
|---|---|---|---|
| 1,997,378 | 4/1935 | Driver | 383/126 |
| 2,719,663 | 10/1955 | Meyer-Jagenberg | 206/626 |
| 2,896,839 | 7/1959 | Barnes et al. | 206/626 |
| 3,687,352 | 8/1972 | Kalajian | 206/626 |
| 3,711,011 | 1/1973 | Kugler | 383/66 |
| 4,260,061 | 4/1981 | Jacobs | 206/626 |
| 4,552,269 | 11/1985 | Chang | 206/632 |

*Primary Examiner*—Stephen P. Garbe
*Attorney, Agent, or Firm*—Richard L. Miller

[57] ABSTRACT

A container having an access opening and a resealable sealing device, the latter consisting of a closure flap which is secured at one end region to the front side of the container and is coated with a pressure-sensitive adhesive to permit the container to be opened and resealed. A pair of cuts are formed in the flap to define a pair of tabs or fingers integral with the one end region of the flap, and a pair of tear prevention holes are formed at the ends of the cuts on the line of attachment of the body of the flap to the one end region thereof, all to prevent the flap from tearing away from the container. A non-adhesive member is cut out of the front side of the container to define the access opening and is adhesively secured to the coated face of the flap.

2 Claims, 7 Drawing Figures

CONTAINER RESEALABLE SEALING DEVICE CONSTRUCTION

BACKGROUND OF THE INVENTION

The invention relates generally to small, flexible containers having sealing devices which may be resealed after having been opened, such as are frequently used for containing plural articles intended to be sequentially extracted from the container and requiring continuous protection prior to their use, e.g. paper tissues, moist towelettes, and the like. More specifically it relates to a container resealable sealing device.

Numerous containers have been provided in prior art in which the contents of the containers are protected by a trouble-free reusable seals, so that such contents, for example, paper tissues, moist towelettes, and the like, can be extracted one at a time from the containers upon opening of the seals and so that after the seals have been reclosed the remaining contents of the containers will be protected as before. For example, U.S. Pat. Nos. 4,420,080 and 4,552,269 are illustrative of such prior art. While these units may be suitable for the particular purpose to which they address, they would not be as suitable for the purposes of the present invention as heretofore described.

SUMMARY OF THE INVENTION

A primary object of the present invention is to provide a container resealable sealing device that will overcome the shortcomings of the prior art devices.

Another object is to provide a container resealable sealing device in which the end region of the closure flap which is secured to the front side of the container is prevented from being torn from the latter when the flap is pulled up to open the container.

An additional object is to provide a container resealable sealing device in which the frequent flexing of the flap during opening and closing of the container, the non-adhesive member will not shift its position on the flap or will not become separated therefrom and will properly and fully overlie the opening in the front side of the container when the flap is closed.

A further object is to provide a container resealable sealing device that is simple and economical to use.

A still further object is to provide a container resealable sealing device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENT

Figure 1:
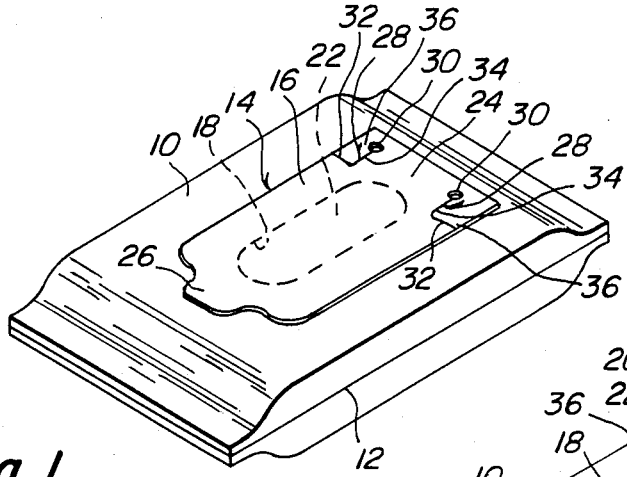
FIG. 1 is a perspective view of the invention shown in a sealed position.
Figure 2:
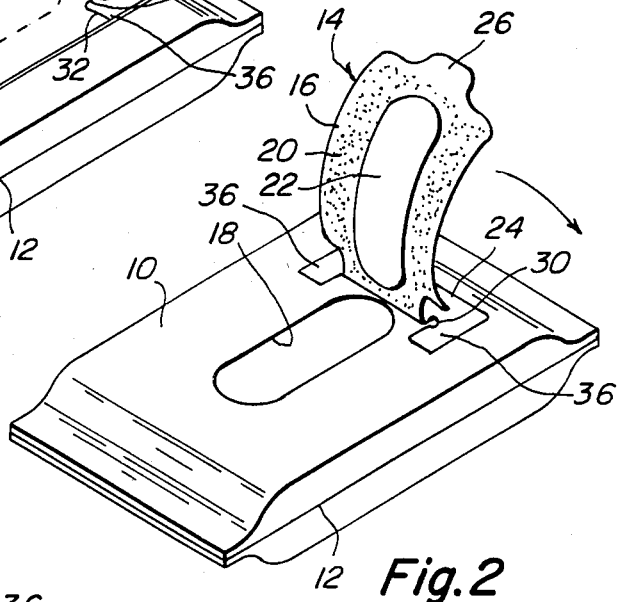
FIG. 2 is a similar view shown in an open position.
Figure 5:
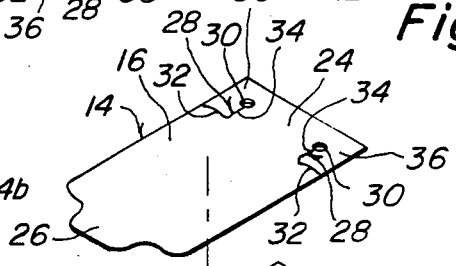
FIG. 5 is an exploded perspective view of the assembled invention illustrating the container flap removed.
Figure 5:
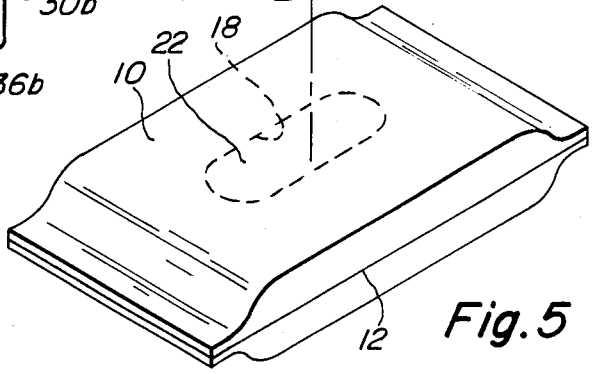

Turning now descriptively to the drawings, in which similar reference characters denote similar elements throughout the several views FIGS. 1, 2 and 5 illustrate a container in the form of a flexible pouch 10 having on each side an accordion fold 12 to allow for expansion of the pouch upon insertion of its contents and contraction of the pouch upon withdrawal of its contents and having on its front side a sealing device 14 including a flap 16 which covers and uncovers an opening 18 through which access may be had to the contents of the container. The flap has its face which is engaged with the front side of the container coated with a layer of pressure-sensitive adhesive 20. A non-adhesive member 22, which is smaller than the flap 16, is of the same shape and size as the opening 18 and is adhesively secured to that face of the flap in a position thereon such that when the flap is closed as in FIG. 1 the member 22 also overlies the opening 18 to prevent the adhesive on the flap from coming into contact with the container contents, e.g. tissues, towelettes, and the like. The flap 16 further has an end region 24 by which it is permanently secured to the front side of the container and at its opposite end has a finger grip 26 which allows the user to lift the flap in order to open the container, with the main body of the flap hinging relative to the end region 24 about a line of attachment (not shown).

In accordance with the basic concept of the present invention, tearing of the flap 16 beyond the line of attachment upon opening of the sealing device 14 is prevented by the provision of a pair of generally L-shaped cuts 28 and an associated pair of tear prevention holes 30 in the flap 16. Each cut (see also FIG. 4) has a first portion 32 starting at a respective side edge of the main body of the flap and extending transversely inwardly of the flap intermediate the ends of the latter, and a second portion 34 continuing from the innermost end of the respective portion 32 and extending generally longitudinally of the flap toward and terminating at the line of attachment. The rear prevention holes 30 are formed on the line of attachment and at the terminations of their associated portions 34 of the L-shaped cuts. The transverse spacing between the longitudinal cut portions 34 is somewhat greater than the width of the non-adhesive member 22 that is located between those portions of the cuts.

As clearly shown, by virtue of the L-shaped cuts the flap 16 has a pair of generally longitudinally extending tabs or fingers 36 defined at the remote sides of the second portions 34 of the cuts, which tabs or fingers are integral enlargements of the end region 24 of the flap. The tabs or fingers 36 serve to enhance the ability of the end region 24 to anchor the flap 16 to the front side of the container 10. It will be understood that the non-adhesive member 22 of the sealing device is formed by being die-cut in a form directly out of the part of the sheet of which the front side of the container 10 is constituted as shown in FIG. 5.

Figure 6:
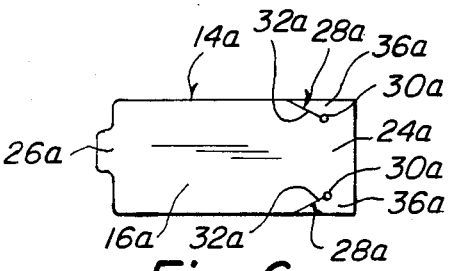
FIG. 6 is a top view of a second type of the sealing flap.

FIG. 6 shows a second type of sealing device 14a in which tearing of the flap 16a beyond the line of attachment upon opening of the sealing device is prevented by the provision of a pair of angular cuts 28a and an associated pair of tear prevention holes 30a in the flap 16a. Each cut has an angular portion 32a starting at a respective side edge of the main body of the flap and extending inwardly of the flap intermediate the ends of the latter toward and terminating at the line of attachment. The tear prevention holes 30a are formed on the line of attachment and at the terminations of the angular portions 32a of the angular cuts. The transverse spacing between the angular portions 32a is somewhat greater than the width of the non-adhesive member 22 that is located between those portions of the cuts.

A clearly shown, by virtue of the angular cuts the flap 16a has a pair of generally longitudinally extending tabs of fingers 36a defined at the remote sides of the angular portions 32a of the cuts, which tabs or fingers are integral enlargements of the end region 24a of the flap. The tabs or fingers 36a serve to anchor the flap 16a to the front side of the container 10.

Figure 7:
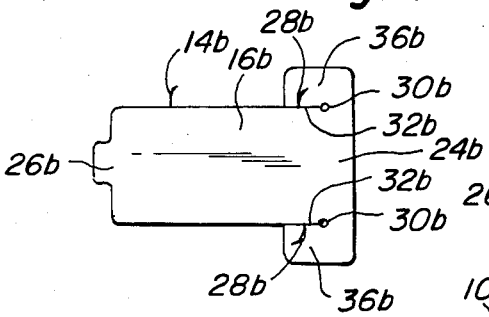
FIG. 7 is a top view of a third type of the sealing flap.

FIG. 7 shows a third type of sealing device 14b in which tearing of the flap 16b beyond the line of attachment upon opening of the sealing device is prevented by the position of a pair of straight cuts 28b and an associated pair of tear prevention holes 30b in the flap 16a. Each cut has a straight portion 32b starting at a respective side edge of the main body of the flap and extending inwardly of the flap intermediate the ends of the latter toward end terminating at the line of attachment. The tear prevention holes 30b are formed on the line of attachment and at the terminations of the straight portions 32b of the angular cuts. The transverse spacing between the straight portions 32b is somewhat greater than the width of the non-adhesive member 22 that is located between those portions of the cuts.

A clearly shown, by virtue of the straight cuts, the flap 16b has a pair of generally longitudinally extending tabs of fingers 36b defined at the remote sides of the straight portions 32b of the cuts, which tabs of fingers are integral enlargements of the end region 24b of the flap. The tabs or fingers 36b serve to enhance the ability of the end region 24b to anchor the flap 16b to the front side of the container 10.

It will be understood that the set of tear prevention holes 30 and the line of attachment between the two portions of the flap 16 and the front side of the container 10 serve to relieve stresses at the line, thereby inhibiting tearing of the flap beyond the line of attachment.

Figure 3:
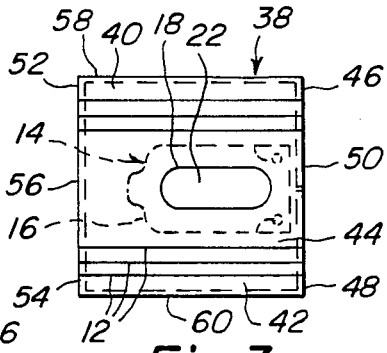
FIG. 3 is a top view of the container blank shown after die cutting but before folding with the sealing flap shown superimposed in dotted line.

For the purpose of making a container 10 of the type shown in FIGS. 1, 2 and 5, use is made, as shown in FIG. 3, of a blank 38 of thin flexible sheet material, e.g. paper, plastic, foil or the like, which is cut into a rectangular shape. Accordion folds 12 are formed in the blank, and a die-cut is made to form simultaneously both the outline of an access opening 18 in the portion of the blank between the accordion folds and a non-adhesive member 22 or corresponding shape.

Figure 4:
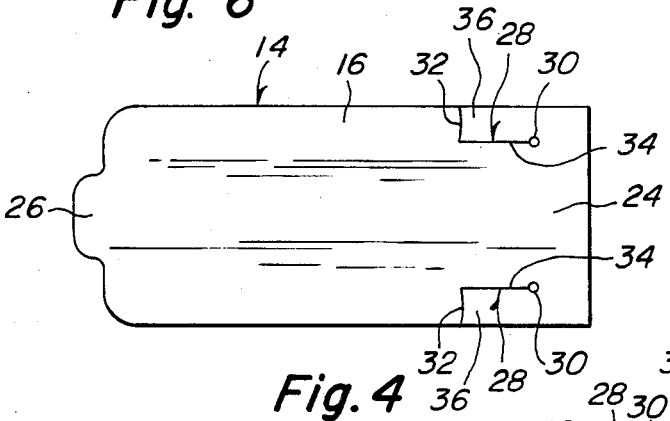
FIG. 4 is an enlarged top view of the dealing device per se.

In order to form the container, the sections 40 and 42 of the blank are laid over the back face of the section 44 of the blank with the accordion folds 12 at the sides, the edges 46 and 48 are secured to the edge 50 by a permanent seal, the edges 52 and 54 are secured to the edge 56 by a permanent seal, and the overlapping edges 58 and 60 are secured to each other by a permanent seal. After the container has been so formed, a resealable sealing device 14 is formed by attaching a closure flap 16, the structure of which is as shown in FIG. 4, to the front side of the container in overlying relation to the member 22 with the aid of a layer of pressure-sensitive adhesive 20 as shown in broken lines in FIG. 3.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved container of the type including a front side having an opening to provide access to contents of said container and a resealable sealing device for said opening, wherein said sealing device includes a closure flap which is larger than said opening and is secured to said front side of said container at one end region of said flap adjacent one portion of a periphery of said opening for hinging movement about a line of attachment between a body of said flap and said one end region thereof so as to be able to overlie said opening, with a face of said flap which is engaged with said front side of said container being coated with a pressure-sensitive adhesive, and wherein said sealing device further includes a non-adhesive member which is smaller than said flap but at least the same shape and size as said opening, with said non-adhesive member being adhesively secured to said coated face of said flap in a position thereon where said member will completely overlie said opening when said flap is adhered to said front side of said container; wherein said improvement comprises:

(a) said flap having a pair of opposing cuts formed therein, each of which starts at a respective side edge of said flap and extends inwardly of said flap and continues toward and terminating at said line of attachment, said cuts being spaced from each other by a distance greater than the width of said non-adhesive member located between said cuts, in that said two cuts define at remote sides thereof a pair of generally longitudinally extending tabs constituting respective integral enlargements of said one end region of said flap so as to enhance anchoring of said flap to said front side of said container; and (b) said flap further having a pair of tear prevention holes formed therein which are located on said line of attachment and each at said termination of a respective one of said cuts, whereby a tearing of said flap beyond said line of attachment and off said container is effectively inhibited, wherein each of said cuts further includes an angular portion starting at its respective side edges of the body of said flap and extending inwardly of said flap intermediate ends of the latter toward and terminating at said line of attachment.

2. An improved container of the type including a front side having an opening to provide access to contents of said container and a resealable sealing device for said opening, wherein said sealing device includes a closure flap which is larger than said opening and is secured to said front side of said container at one end region of said flap adjacent one portion of a periphery of said opening for hinging movement about a line of attachment between a body of said flap and said one end region thereof so as to be able to overlie said opening, with a face of said flap which is engaged with said front side of said container being coated with a pressure-sensitive adhesive, and wherein said sealing device further includes a non-adhesive member which is smaller than said flap but at least the same shape and size as said opening, with said non-adhesive member being adhesively secured to said coated face of said flap in a position thereon where said member will completely overlie said opening when said flap is adhered to said front side of said container; wherein said improvement comprises:

(a) said flap having a pair of opposing cuts formed therein, each of which starts at a respective side edge of said flap and extends inwardly of said flap and continues toward and terminating at said line of attachment, said cuts being spaced from each other by a distance greater than the width of said non-adhesive member located between said cuts, in that said two cuts define at remote sides thereof a pair of generally longitudinally extending tabs constituting respective integral enlargements of said one end region of said flap so as to enhance anchoring of said flap to said front side of said container; and (b) said flap further having a pair of tear prevention holes formed therein which are located on said line of attachment and each at said termination of a respective one of said cuts, whereby a tearing of said flap beyond said line of attachment and off said container is effectively inhibited, wherein each of said cuts further includes a straight portion starting at its respective side edges of the body of said flap and extending inwardly of said flap intermediate ends of the latter toward and terminating at said line of attachment.

* * * * *